US005809918A

United States Patent [19]

Tajima et al.

[11] Patent Number: 5,809,918

[45] Date of Patent: Sep. 22, 1998

[54] SEWING MACHINE

[75] Inventors: Ikuo Tajima; Tomoyuki Shibata, both of Kasugai, Japan

[73] Assignee: Tokai Industrial Sewing Machine Co., Ltd., Aichi, Japan

[21] Appl. No.: 727,371

[22] Filed: Oct. 8, 1996

[30] Foreign Application Priority Data

| | | | |
|---|---|---|---|
| Oct. 9, 1995 | [JP] | Japan | 7-288057 |
| Oct. 26, 1995 | [JP] | Japan | 7-301940 |
| Dec. 27, 1995 | [JP] | Japan | 7-353604 |

[51] Int. Cl.[6] ..... D05B 21/00

[52] U.S. Cl. ..... 112/103; 112/470.18

[58] Field of Search ..... 112/103, 470.14, 112/470.18, 98, 102

[56] References Cited

U.S. PATENT DOCUMENTS

| | | | |
|---|---|---|---|
| 4,208,975 | 6/1980 | Teetz | 112/103 X |
| 4,495,876 | 1/1985 | Tajima | 112/103 X |
| 4,602,578 | 7/1986 | Yokoe et al. | 112/470.18 |
| 4,628,843 | 12/1986 | Tajima | 112/103 |
| 5,005,501 | 4/1991 | Kita | 112/103 X |
| 5,081,943 | 1/1992 | Nakanishi | 112/470.18 |
| 5,159,888 | 11/1992 | Morita | 112/103 X |
| 5,400,728 | 3/1995 | Zinssmeister | 112/470.18 |

*Primary Examiner*—Paul C. Lewis
*Attorney, Agent, or Firm*—Koda & Androlia

[57] ABSTRACT

Disclosed is a sewing machine having a horizontal sewing table, an X-direction frame drive portion and a Y-direction frame drive portion, which are disposed downward of said sewing table, and a long frame drive member disposed upward of said sewing table, which is freely movable on the X and Y coordinates surface by both the frame drive portions. A guide member long in the Y direction is provided so as to be horizontally located upward of the intermediate position in the X direction at the frame drive member. A moving member disposed at this guide member so as to be movable in the Y direction is movable integrally therewith in the Y direction relative to the frame drive member and is connected thereto so as to be relatively movable in the X direction. A sub drive mechanism is able to move the moving member in synchronization with the drive of the Y-direction frame drive portion.

3 Claims, 13 Drawing Sheets

SEWING MACHINE

BACKGROUND OF THE INVENTION

The present invention relates to a sewing machine in which a frame movement mechanism is improved which is able to control the movements of an embroidering frame by which textile fabrics such as cloth to be embroidered are stretched and maintained.

DESCRIPTION OF THE RELATED ARTS

Various types of drive mechanisms, by which a embroidering frame located on a horizontal sewing table is controllably moved in the X direction and Y direction (that is, longitudinal direction and cross direction) on the plane coordinates on the basis of various kinds of sewing data stored in a computer, have been proposed and used. For example, FIG. 14 shows an embroidering sewing machine provided with two units of sewing heads 5,5 (hereinafter called a sewing machine), and said sewing machine is provided with a long frame drive member 10 which maintains an embroidering frame 26 (that is, a frame by which a material texture being cloth to be embroidered is stretched and maintained) located on a sewing table 6, and a drive mechanism 59 which is able to cause said embroidering frame 26 to move in the cross direction (hereinafter called Y direction) and in the longitudinal direction (hereinafter X direction) on said table. That is, a Y-direction drive portion 11 which causes said embroidering frames 26 to move in the Y direction is disposed on the underside of the sewing table 6. Said Y-direction drive portion 11 consists of pulleys 67,68 which are respectively rotatably supported at the forward position and rearward position, a belt 69 suspended between said pulleys 67,68, a drive motor 14 is connected to the left and right pulleys 68,68 located at the rearward portion via a connection axis 13, etc. Two belts 69,69 located at the left and right sides are connected to both the ends of said frame drive member 10 via slits 12,12 formed in the Y direction at the sewing table 6. Therefore, by controlling the normal and reverse rotations of said drive motor 14, said frame drive member 10 and said embroidering frames 26 supported on said frame drive member 10 are caused to move in the Y direction. Furthermore, a cylinder type bobbin supporting member 7 is disposed downward of the respective sewing heads 5 corresponding thereto.

Furthermore, an X-direction drive portion 21 which causes said embroidering frames 26 to move in the X direction is disposed inside said frame drive member 10. Said X-direction drive portion 21 consists of pulleys 71,72 which are respectively rotatably supported at both the left and right ends thereof, a belt 73 suspended between these pulleys 71,72, and a drive motor 74 directly connected to the pulley 72 disposed at the right side thereof. Connecting members 75,75 are attached to said belt 73 with an appointed interval held therebetween, said embroidering frames 26 are horizontally attached to the connecting member 75, and protrude toward the front side of said frame drive member 10. Therefore, by normally or reversely rotating said drive motor 74, said embroidering frames 26 are caused to reciprocate in the X direction.

In the drive mechanism 59 which is able to move the above-mentioned embroidering frames 26 in the X direction and Y direction, since the X-direction drive portion 21 which causes said embroidering frames 26 to move in the X direction is provided inside said frame drive member 10, it is possible to make said sewing table 6 small-sized. Therefore, the above example is preferably embodied in a small-sized sewing machine having a small number of sewing heads as in this example. However, as regards a small-sized embroidering sewing machine equipped with the abovementioned frame drive mechanism, it is highly desired that a sewing machine having many more sewing heads provided (that is, a sewing machine of such a type that a greater number of sewing heads are provided with the total size thereof suppressed by adoption of the abovementioned drive mechanism) is developed. Actually however, if the number of sewing heads is increased, the total length of the frame drive member 10 is necessarily increased to cause the weight of said drive member 10 to be increased together with an increase of the weight of the embroidering frames 26 attached to said frame drive member 10. Furthermore, the frame drive member 10 whose total length was increased is connected to the Y direction drive portions 11,11 at only both the ends thereof. Therefore, strain is likely to occur at the intermediate portion in the lengthwise direction thereof when driving the frame. Accordingly, it is not possible to accurately carry out the feed actions of the embroidering frame 26, resulting in such a disadvantage that a so-called image slip in an embroidering image at the respective sewing heads occurs.

SUMMARY OF THE INVENTION

In view of the shortcomings inherent to a sewing machine according to the prior arts described above, the invention is proposed to preferably solve the shortcomings. It is therefore an object of the invention to provide a sewing machine in which the embroidering frames are able to be accurately moved even though many sewing heads are provided, despite a frame drive mechanism of such a type suited to a small-sized sewing machine being provided.

DETAILED DESCRIPTION OF THE PREFERRED EMBODIMENTS

Figure 1:
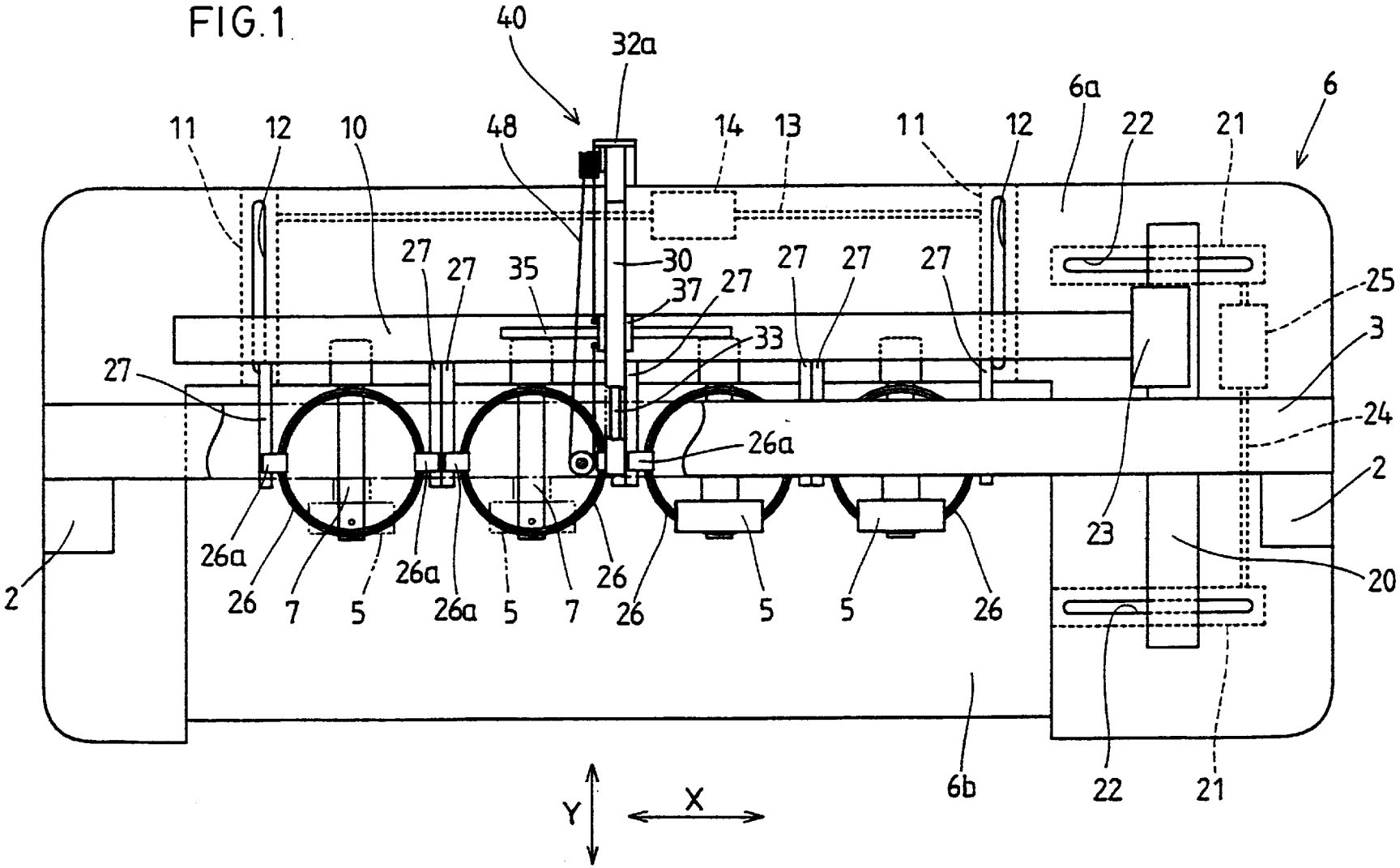
FIG. 1 is a plan view of a sewing machine according to a preferred embodiment of the invention.
Figure 2:
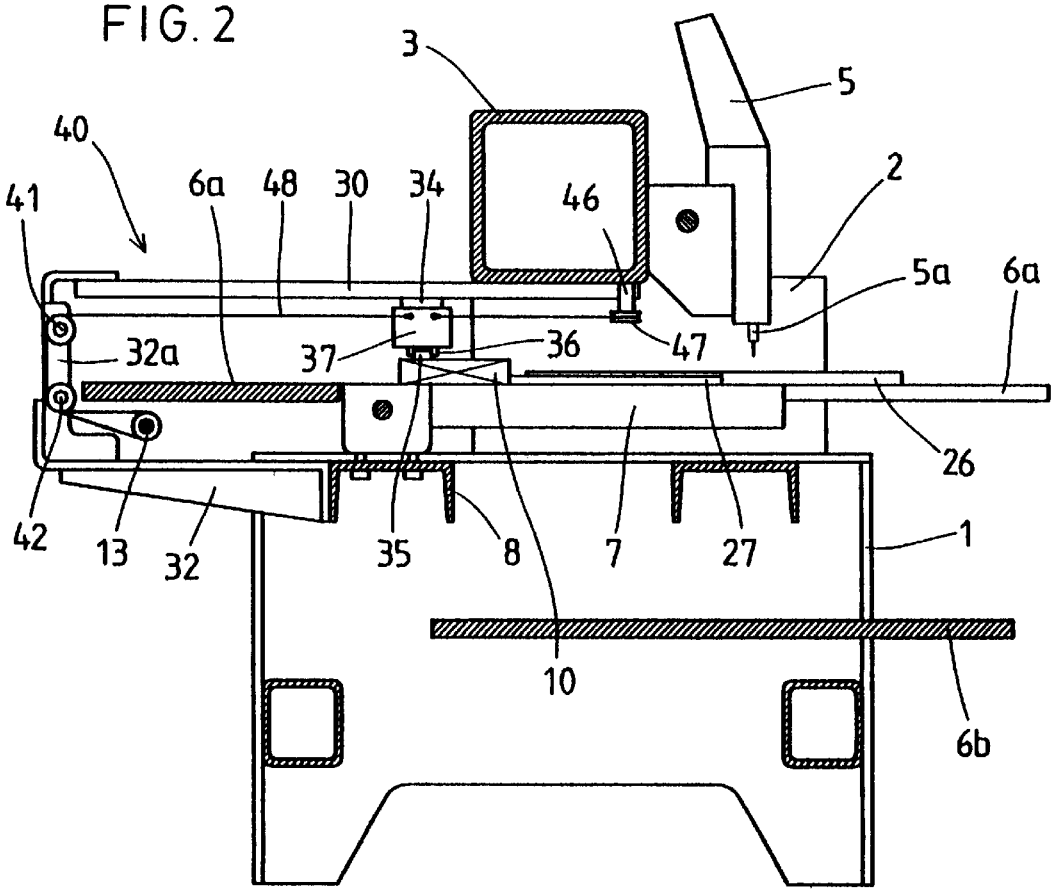
FIG. 2 is a longitudinal side view of a sewing machine illustrated in FIG. 1.

A preferred embodiment in which the present invention is embodied in a multi-head type embroidering sewing machine is described with reference to the drawings attached herewith. FIG. 1 and FIG. 2 show a multi-head type embroidering sewing machine according to a first preferred embodiment. Said sewing machine is provided with supporting frames 2,2 which are erect at both the left and right sides of a horizontally long base 1 and a long upper frame 3 is horizontally disposed on the top of said supporting frames 2,2. A plurality of sewing heads 5 (in this embodiment, 4 heads) are disposed at the front side of said upper frame 3 with an appointed interval, and a sewing table 6 is horizontally disposed at the lower position of the upper frame 3. This sewing table 6 is, as shown in FIG. 2, divided into a fixed table 6*a* located upward and an elevation table 6*b* located downward thereof.

A cylinder type bobbin supporting member 7 is disposed downward of the respective sewing heads 5 corresponding thereto. That is, as shown in FIG. 2, the bobbin supporting member 7 is fixed on the upper face of the lower frame 8 at the base, and the height of the upper face of said bobbin supporting member 7 is set to such a dimension as is coincident with the upper face of said fixed table 6*a*. An already-known bobbin (not illustrated) is internally disposed at the front edge of this bobbin supporting member 7 and is such that various kinds of sewing such as embroidery are carried out on textile fabrics to be embroidered under the cooperation of a sewing needle in a needle support 5*a* elevatably provided at said sewing head 5.

A long plate-like frame drive member 10 is placed on the upper face of said fixed table 6*a* and extends in parallel with the upper frame 3. Said frame drive member 10 is, as shown in FIG. 1, connected to two sets of Y-direction drive portions 11,11 disposed at the underside of said fixed table 6*a* with an predetermined interval in the X direction. The respective Y-direction drive portions 11 are a general drive mechanism which is able to give rectilinear reciprocatory movements to the frame drive member 10, and, which is formed on the underside of the frame drive member 10, via a Y-direction slit 12 secured at said fixed table 6*a* and is fitted therein. Furthermore, the two Y-direction drive portions 11,11 are connected to each other via a linkage member axis 13 and a Y-direction drive motor 14, and by causing said drive motor 14 to alternately normally or reversely rotate, said Y-direction drive portions 11,11 are able to cause said frame drive member 10 to reciprocate F in the Y direction. Since said frame drive member 10 is allowed to move in the X direction, said frame drive member 10 is caused to move in the X direction upon receiving a drive force from the X-direction drive portion 20.

The X direction drive member 20 is placed on the upper face of said fixed table 6*a*, and both the ends in the Y direction thereof are connected to the X-direction drive portion 21 disposed on the underside of said fixed table 6*a*. Said X-direction drive portion 21 is provided with a drive mechanism which is similar to said Y-direction drive portion 11, and the drive elements thereof (not illustrated) are respectively connected to the underside of said X-direction drive member 20 via the X-direction slit 22 secured at said fixed table 6*a*. Said X-direction drive member 20 is linked with the right end part of the frame drive member 10 via a linkage member 23, and said frame drive member 10 is able to move in the X direction integrally with the X-direction drive portion 20, and at the same time is able to independently move in the Y direction. Two X-direction drive portions 21,21 are connected to each other via said linkage rod 24 and X-direction drive motor 25, and by causing said drive motor 25 to normally or reversely rotate alternately, said frame drive member 10 is caused to reciprocate in the X direction via the X-direction drive part 21, X-direction drive part 20 and linkage member 23.

A pair of left and right holding arms 27, by which embroidering frames 26 are held corresponding to the respective sewing heads 5, are secured and fixed at said frame drive member 10. The attaching position of the respective holding arms 27 corresponding to said frame drive member 10 is adjustable in response to the size of the embroidering frames 26 to be held. Furthermore, said embroidering frames 26 are attached to said holding arms 27,27 via linkage rods 26*a*, 26*a* secured at both the ends thereof.

Figure 4:
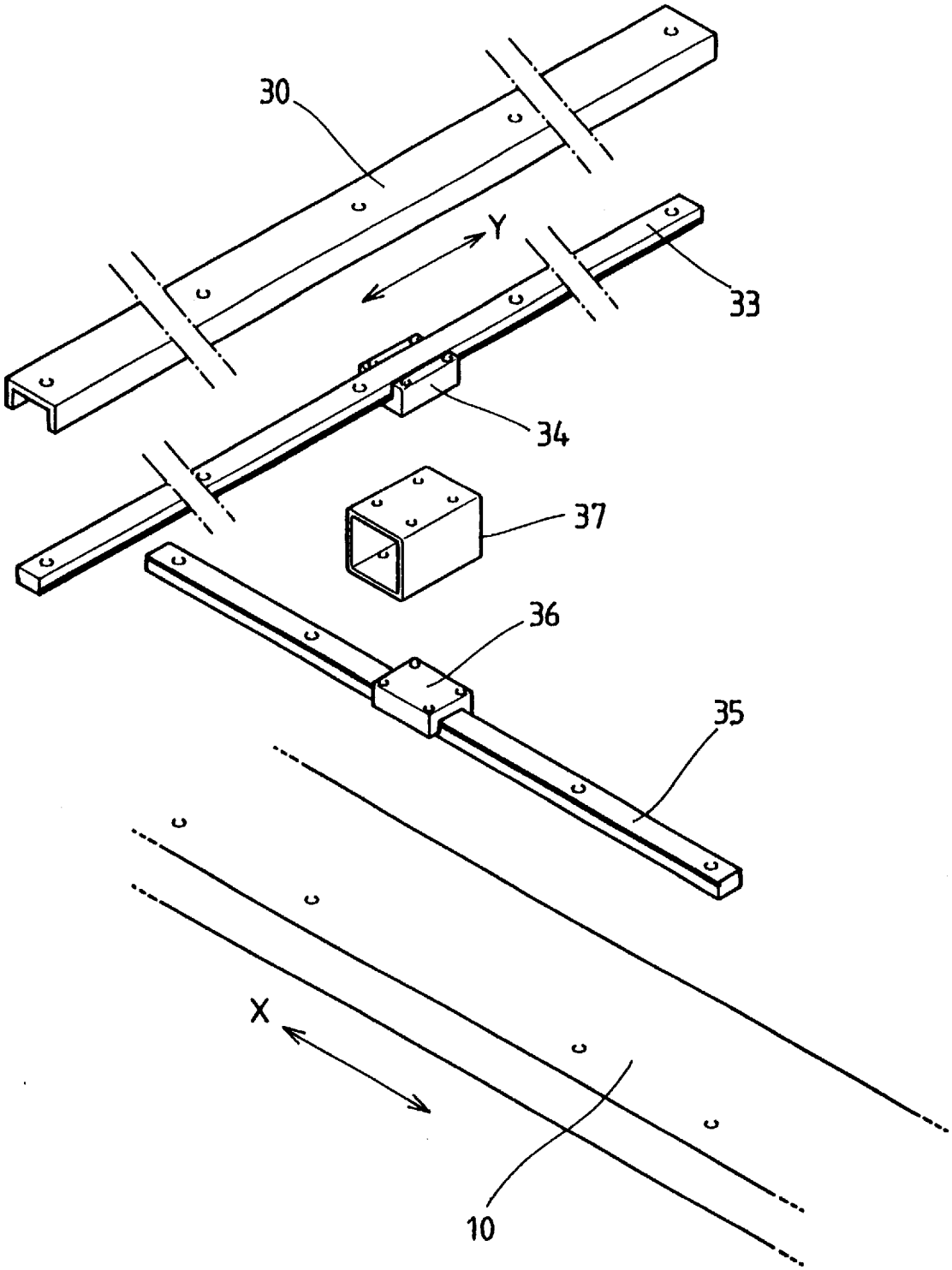
FIG. 4 is a perspective view showing a disassembled state of a connection between a moving member and a frame drive member.

This sewing machine is provided with a mechanism by which the posture of said frame drive member 10 is retained to be fixed at all times. That is, a supporting bracket 30 which is made long in the Y direction is roughly horizontally placed at a roughly middle position of the two Y-direction drive portions 11,11 upward of said frame drive member 10, and the front end thereof is fixed at the underside of the upper frame 3 as shown in FIG. 2. Similarly, as shown in FIG. 2, the rear end of said supporting bracket 30 is fixed at the erect part 32*a* of a bracket 32 secured and fixed at the rear side of the lower frame 8. As shown in FIG. 4, a linear rail 33 which constitutes an example of a guide member is fixed at the underside of said supporting bracket 30, and a slider 34 is fitted into said linear rail 33. A moving member 37 described later is secured and fixed at the underside of said slider 34. Furthermore, as shown in FIG. 1, a linear rail 35 which is similar to said linear rail 33 is fixed at a roughly central upper surface in the lengthwise direction at the frame drive member 10 at an angle roughly orthogonal to said linear rail 33, and a slider 36 similar to the above example is fitted into said linear rail 35. Said moving member 37 is secured and fixed on the upper surface of said slider 36. Said moving member 37 is caused to reciprocate in the Y direction by a sub drive mechanism 40 described later.

Figure 5:
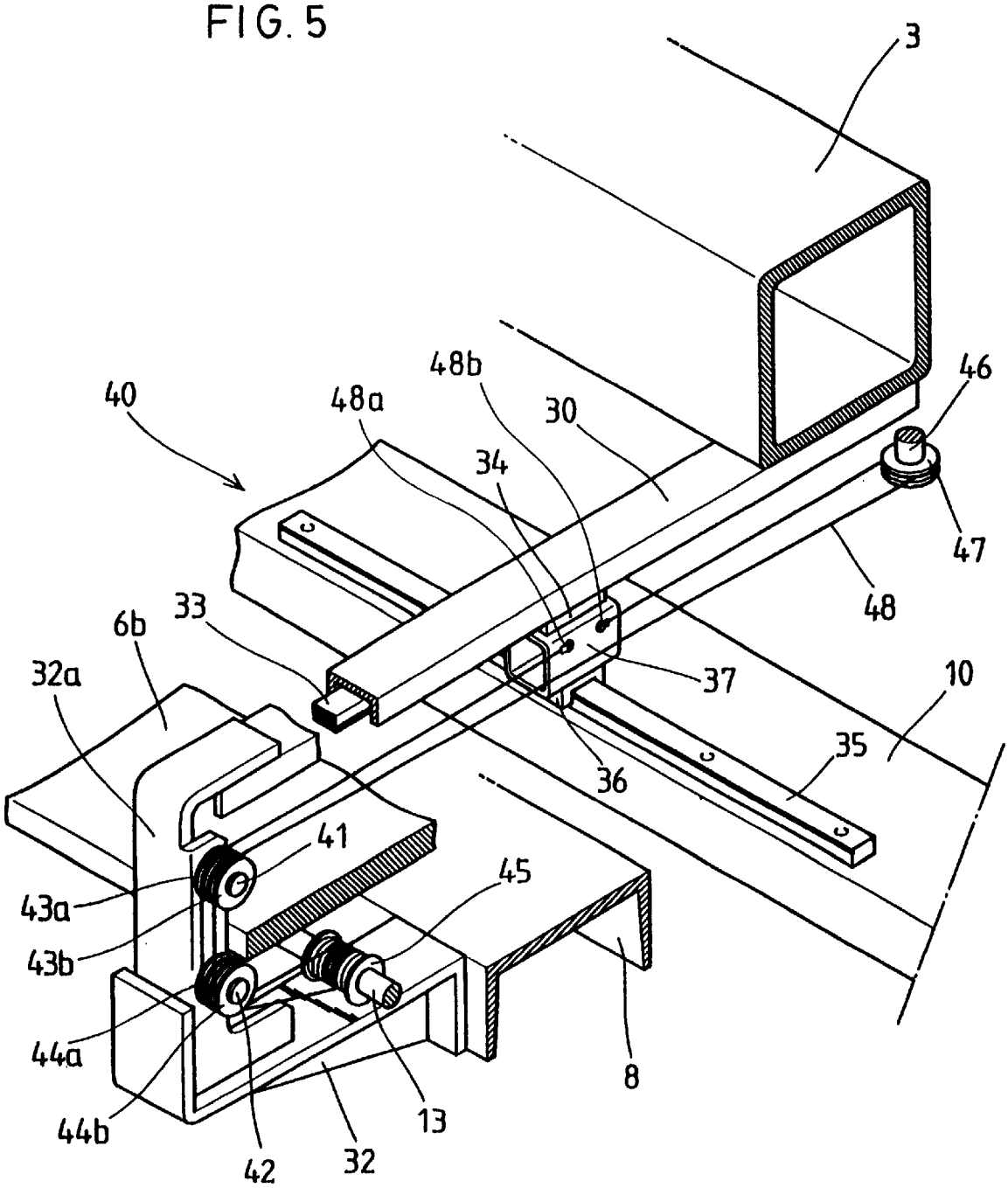
FIG. 5 is a partially disassembled perspective view showing a state that said sub drive mechanism is provided.

Next, a description is given of said sub drive mechanism 40. As shown in FIG. 5, two supporting pins 41,42 are laterally attached to the side of the erect part 32*a* of said bracket 32 fixed at the lower frame 8 with an appointed interval held in the vertical direction, wherein two wire application pulleys 43*a*,43*b* are supported at the upper supporting pin 41 while two wire application pulleys 44*a*, 44*b* are supported at the lower supporting pin 42 as well. A drive pulley 45 having a spiral groove formed at the outer circumference is attached onto the linkage axis 13 connected to the drive motor 14 forward of the two lowerside pulleys 44*a*, 44*b* while a pulley 47 is supported by a pin 46 vertically fixed at the underside of the upper frame 3 forward of the two upperside pulleys 43*a*,43*b*.

Figure 3:
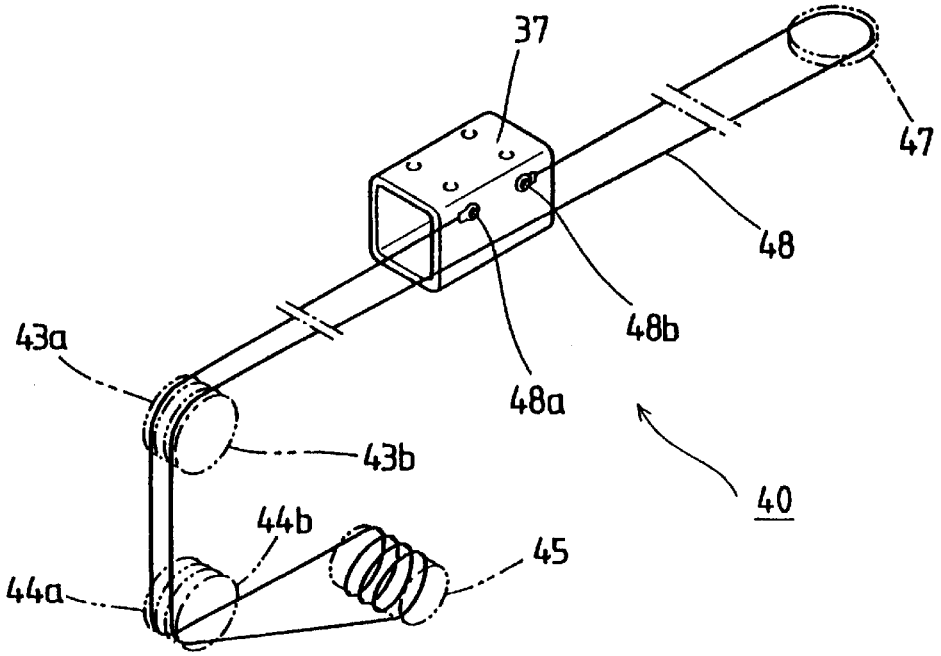
FIG. 3 is a perspective view showing a state of application of wire in a sub drive mechanism.

As shown in FIG. 3 and FIG. 5, a wire 48 is applied to a series of these pulleys 43*a*, 43*b*, 44*a*, 44*b*, 45 and 47. The terminal ends of said wire 48 are connected to the sides of said moving member 37 via linkage members 48*a*, 48*b*. That is, said wire 48 is wound several turns in the spiral groove of said drive pulley 45 via pulleys 43*a*, 44*a* after the same horizontally extends rearwards from one linkage member 48*a*. Thereafter, the wire 48 turns its direction at the forward pulley 47 after passing through the pulleys 44*b*,43*b*, and is connected to said moving member 37 via the other linkage member 48*b*. Furthermore, the tension of said wire 48 is adjustable by a tension adjusting device (not illustrated). When the linkage member 13 is rotated by normally or reversely turning the drive motor 14 alternately, the drive pulley 45 fixed at said linkage member 13 is caused to rotate, whereby said moving body 37 is caused to reciprocate in the Y direction at the same speed as that of the frame drive member 10 via said wire 48. Thus, since the moving force of the moving member 37 is transmitted to the frame drive member 10 via linear rail 35, said frame drive member 10 not only is driven by two Y-direction drive portions 11,11, but also is driven in the Y direction by the sub drive mechanism 40 according to the above construction. Furthermore, said moving member 37 is, as described above, connected to the frame drive member 10 via the linear rail 35 into which said sliders 35 34 are fitted. Therefore, the abovementioned frame drive member 10 is allowed to move in the X direction by drive of said X-direction drive portion 21.

According to a sewing machine illustrated in FIG. 1 through FIG. 5, since the central portion of the long frame drive member 10 is caused to move at the same speed as that of both the ends thereof by a sub drive mechanism 40 driven by a drive motor 14 (a drive source which causes the frame drive member 10 to move in the Y direction), the frame drive member 10 produces no strain in the lengthwise direction thereof. Therefore, accurate motions are given to the respective embroidering frames 26 connected to the frame drive member 10. Furthermore, the frame drive member 10 will be caused to move in such a state that the vertical movements thereof are completely regulated by a moving member 37 which intervenes at the middle part between the abovementioned linear rail 36 and slider 35, between the slider 34 and linear rail 33 and between both the sliders 35,34. Therefore, even though the weight of textile fabrics to be embroidered, which are stretched and held on said embroidering frames 26, is increased, any hindrance which may produce an inclination of said frame drive member 10 due to overloads transmitted via said holding arms 27 will be effectively prevented. In this preferred embodiment, although such a construction that the central portion of the frame drive member 10 is auxiliary driven by a sub drive mechanism 40 is employed, said sub drive mechanism 40 may be placed at a point other than the central part, or at several points including the above central part, whereby said frame drive member 10 is driven.

Figure 6:
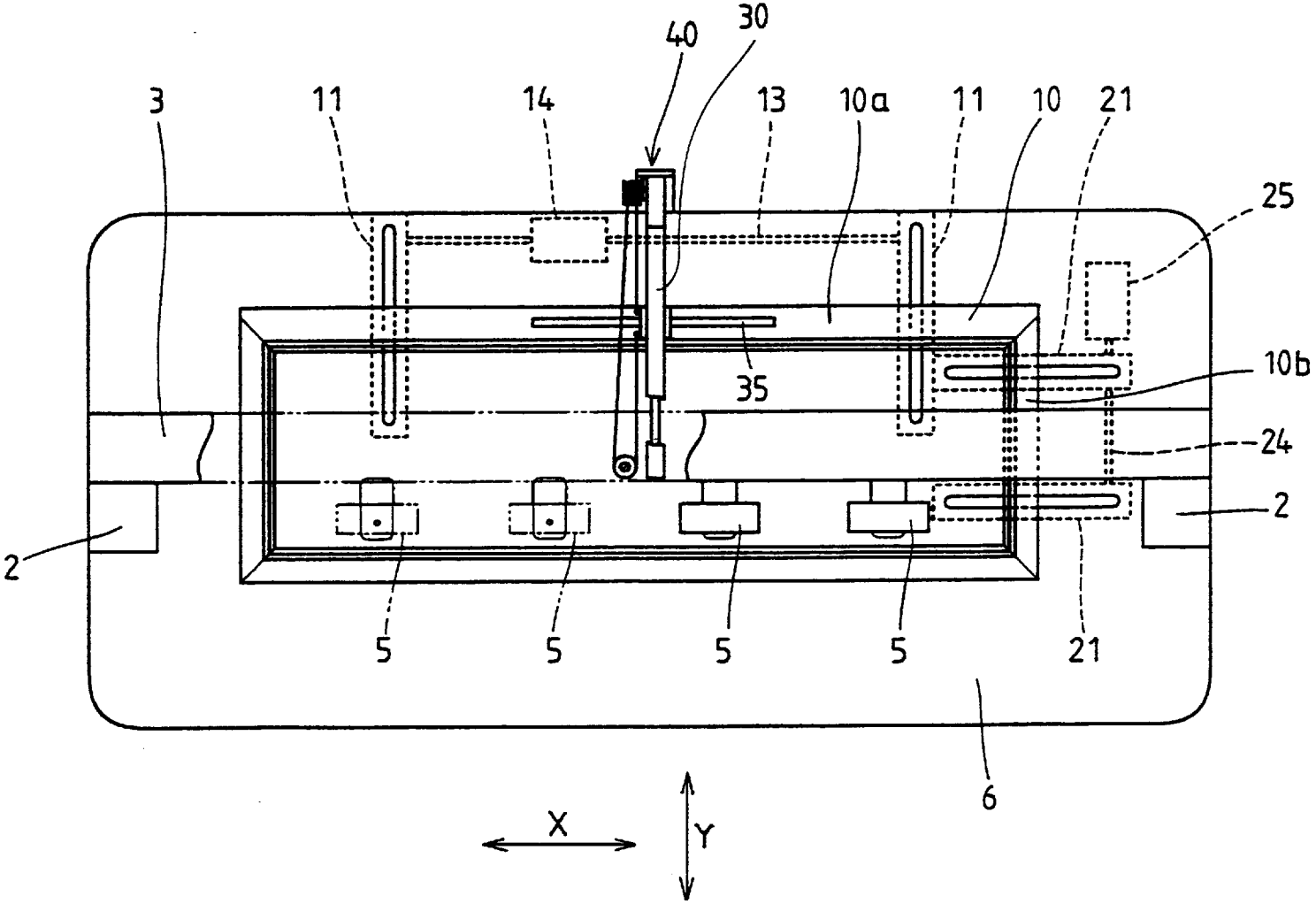
FIG. 6 is a plan view of a sewing machine according to another preferred embodiment of the invention.

Next, FIG. 6 shows another preferred embodiment. A frame drive member 10 according to the first preferred embodiment shown in FIG. 1 through FIG. 5 is in a pattern of a long plate-like member. However, a frame drive member of this preferred embodiment is constructed as a long rectangular member (that is, textile fabric frame). The parts which are identical to or equivalent to those in the preceding preferred embodiment are given the same reference number, and the description thereof is omitted herein.

A frame drive member formed to be long rectangular in the X direction is retained so as to be freely movable on the upper surface of a horizontal sewing table 6. Since said frame drive member 10 is formed to be long rectangular, it is possible to stretch and hold textile fabrics to be embroidered (a piece of the textile fabrics to be cut to a suitable size) directly on said frame drive member 10. Furthermore, it is possible to attach individual embroidering frames 26 to the frame drive member 10 consisting of rectangular frame members and to match the respective embroidering frames 26 to the respective sewing heads 5. Still furthermore, the frame drive member 10 is freely movable on the X-Y coordinates plane by the X-direction drive portion 21 and Y-direction drive portions 11,11, which are disposed on the underside of the sewing table 50. An X-direction guide groove (not illustrated) is formed on the underside of the frame drive member 10 and rear frame portion 10*a*, and a roller (not illustrated) which forms a drive element of the Y-direction drive portion 11 is fitted into this guide groove. Still furthermore, a Y-direction guide groove (not illustrated) is formed on the underside of the right frame portion 10*b* at the frame drive member 10, wherein a roller (not illustrated) which forms a drive element of the X-direction drive portion is fitted into this guide groove as well.

Although this sewing machine is provided with a mechanism which holds the posture of the frame drive member 10 in a fixed state, the basic construction thereof is identical to that explained in the first preferred embodiment in FIG. 1. As in the first preferred embodiment shown in FIG. 1, a linear rail 35 extending in the X direction is attached to the upper surface of the middle portion in the lengthwise direction at the rear frame portion 10*a* of the frame drive member 10, and the intermediate portion of the said rear frame portion 10*a* is caused to move by a sub drive mechanism 40 which is similar to that explained with respect to FIG. 3. Therefore, the rear frame portion 10*a* of the long rectangular frame drive member 10 is caused to move without any deflection in the lengthwise direction thereof. For this reason, it is possible to accurately move textile fabrics stretched and held directly on this frame drive member 10 and an embroidering frame individually attached to each sewing head 5 corresponding thereto.

Figure 7:
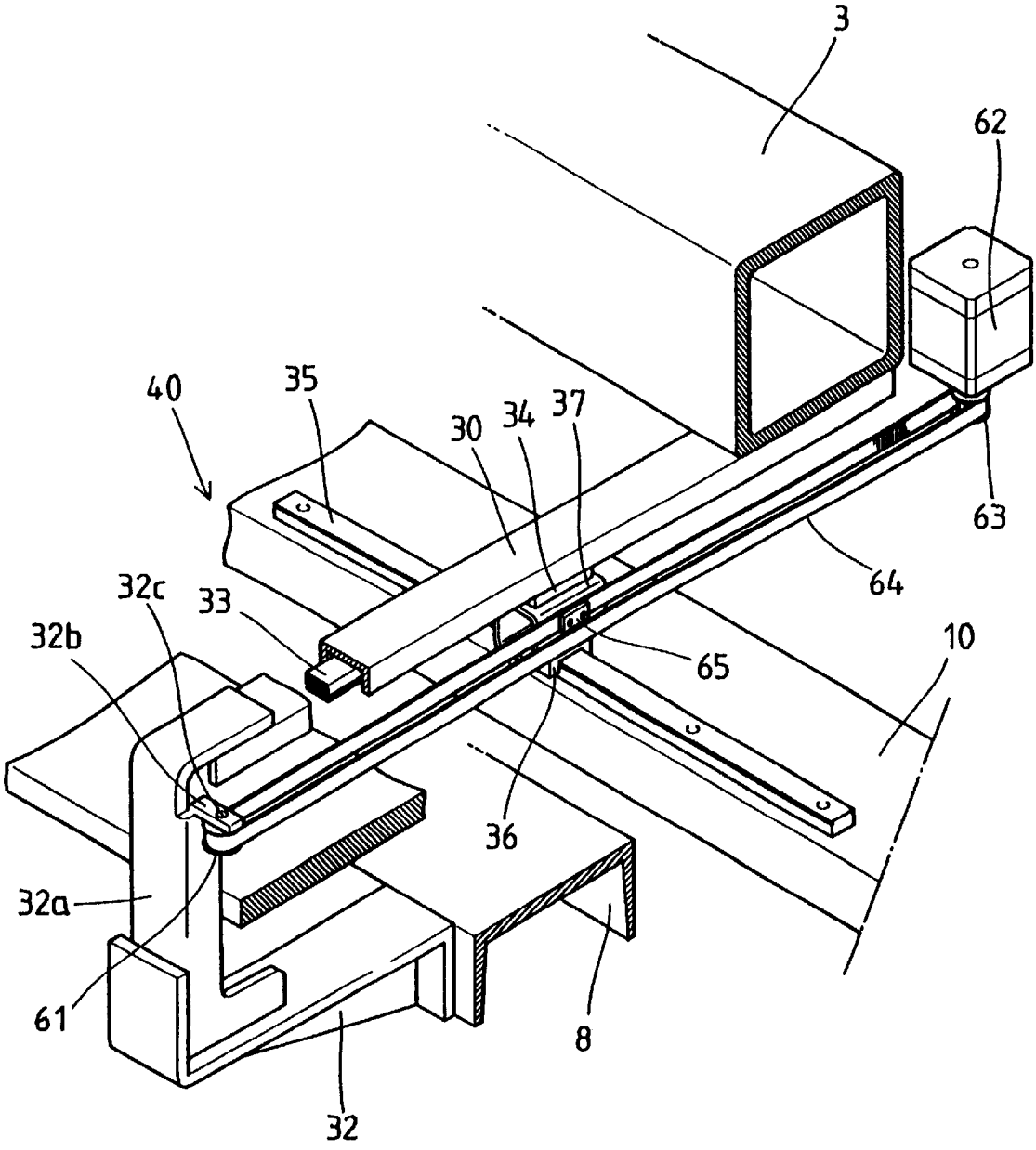
FIG. 7 is a partially disassembled perspective view showing another example of said sub drive mechanism used in the invention.

FIG. 7 shows a sub drive mechanism according to a construction which differs from the sub drive mechanism 40 used in this preferred embodiment. Therefore, the parts which are identical to those described in the preceding preferred embodiment are given the same reference numbers, and the description thereof is omitted herein. Both the ends of a long supporting bracket 30 are, as described above, fixed on the erect portion 32*a* of a bracket 32 fixed at the lower frame 8 and on the underside of the upper frame 3 and extend in the Y direction. A supporting portion 32*b* which horizontally extends in a lateral direction is provided upward of the erect portion 32*a* at said bracket 32, and a pulley 61 is rotatably supported at said supporting portion 32*b* via a vertical pin 32*c*. Furthermore, at the forward side of said supporting bracket 30 and at the portion in the vicinity of the upper frame 3, a drive motor 62 is caused to stand on its head and is disposed there via a bracket (not illustrated). A drive pulley 63 is fixed at the motor axis extending downward in the perpendicular direction of said motor 62. An endless belt 64 is applied between these two pulleys 61,63, and said belt 64 is connected to the side of said moving member 37 via a fixing member 65. Furthermore, said drive motor 62 is driven in synchronization with the motor 14 which drives the frame drive member 10 described above. According to this preferred embodiment, as in the preceding preferred embodiment, since the central portion of the long frame drive member 10 is caused to move by a sub drive mechanism 40, said frame drive member 10 will produce no strain in the lengthwise direction thereof.

Figure 8:
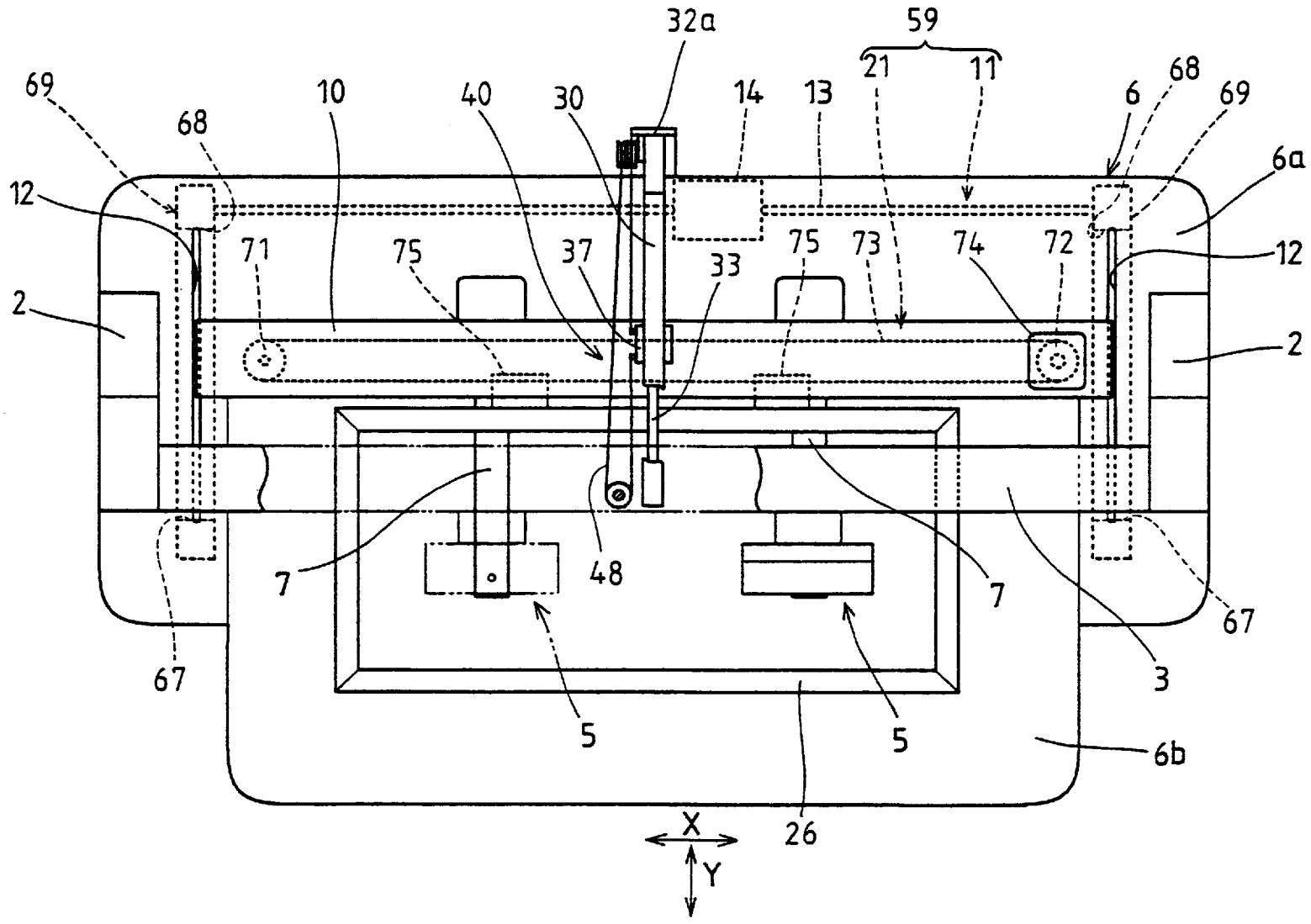
FIG. 8 is a partially disassembled plan view of a sewing machine according to another preferred embodiment of the invention.
Figure 9:
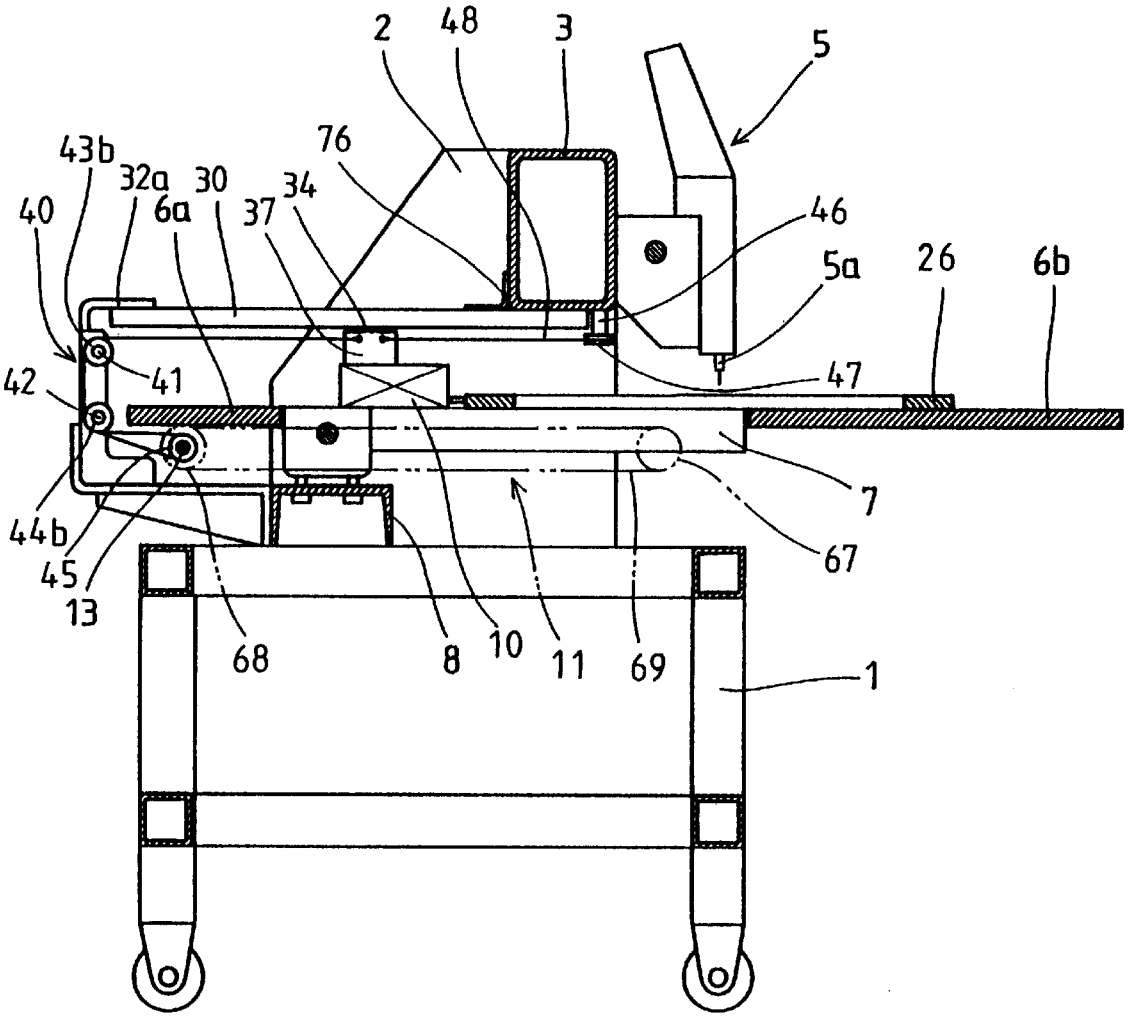
FIG. 9 is a longitudinal side view of a sewing machine illustrated in FIG. 8.
Figure 14:
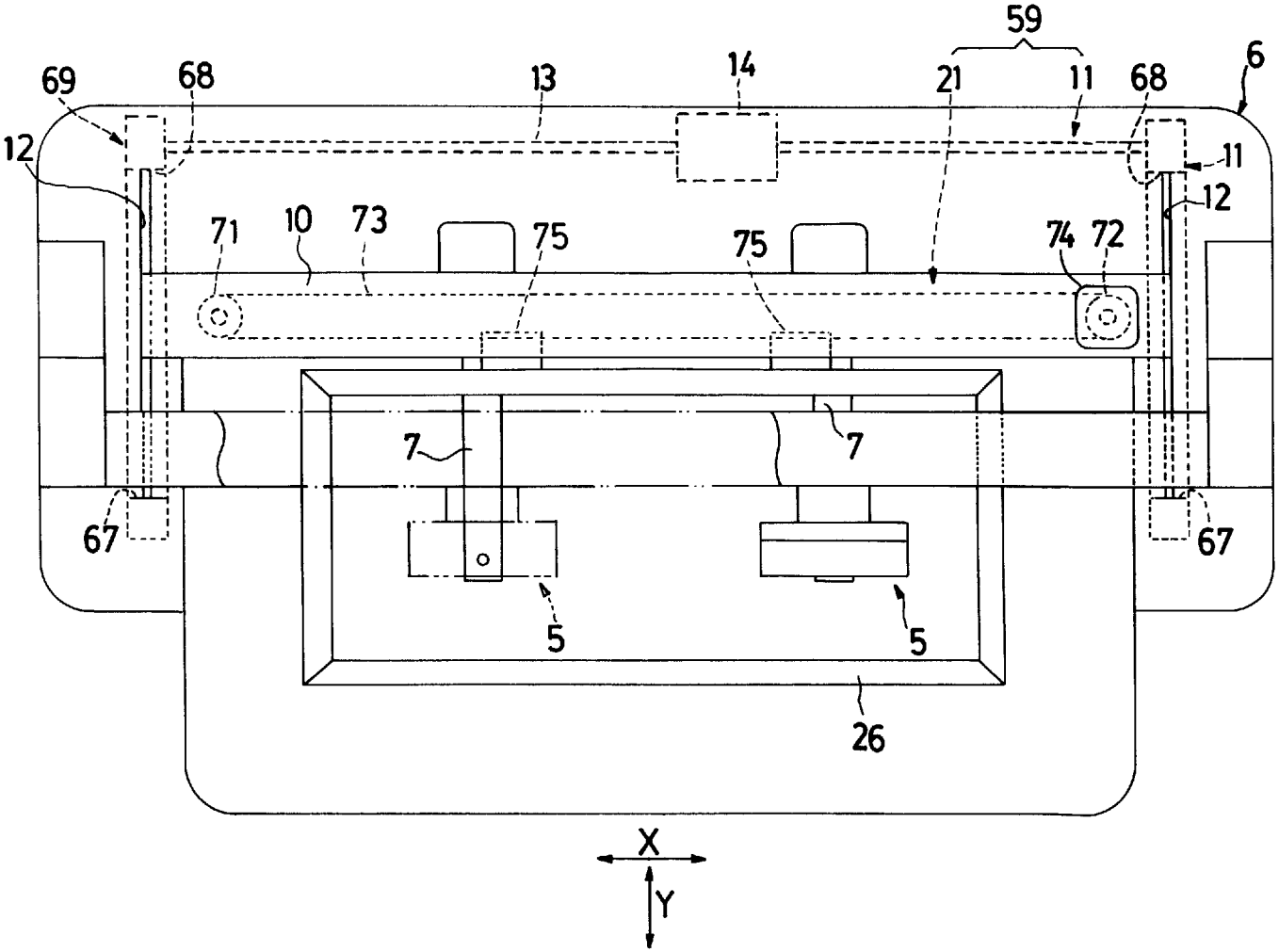
FIG. 14 PRIOR ART
FIG. 14 is a partially disassembled plan view of a sewing machine according to prior arts.

FIG. 8 and FIG. 9 show still another preferred embodiment of the invention. The basic construction thereof is as described with respect to FIG. 14. Therefore, the parts which are identical to those described with reference to FIG. 14 are given the same reference numbers. In the preferred embodiment shown in FIG. 1 described above, although the frame drive member 10 is driven so as to move in the X direction and Y direction, the frame drive member 10 of a sewing machine according to this preferred embodiment is constructed so as to permit reciprocations in only the Y direction. As shown in FIG. 9, a sewing table horizontally disposed downward of the upper frame 3 consists of a fixed table 6*a* located rearward and a movable table 6*b* located forward, and both tables 6*a*,6*b* are set to the same height.

Furthermore, a drive mechanism 59 which causes the embroidering frames 26 to move in the Y direction and X direction is comprised of Y-direction drive portions 11,11 and an X-direction drive portion 21, which are described with respect to FIG. 14. A long rectangular embroidering frame 26 placed on the sewing table 6 is connected to said frame drive member 10 via linkage members 75,75. This embroidering frame 26 is able to stretch and hold textile fabrics as they are and it is possible to provide individual embroidering frames (circular frames, etc.) corresponding to the respective sewing heads 5. Furthermore, it is possible to attach said individual embroidering frames (circular frames, etc.) directly to said linkage member 75. Thus, the embroidering frame 26 is freely movable in the X and Y directions by a drive mechanism 59 consisting of a Y-direction drive portion 11 which causes the frame drive member 10 to move in the Y direction and an X-direction drive portion 21 which causes the linkage member 75 to move in the X direction.

Upward of said frame drive member 10, a supporting bracket 30 long in the Y direction is roughly horizontally disposed at a roughly middle position of the two Y-direction drive portions 11,11, and the front end portion thereof is, as shown in FIG. 9, fixed at the underside of the upper frame 3 via bracket 32*a*, and at the same time the rear end thereof is fixed at at portion 32*a* of a bracket 32 fixed at the rear face of the lower frame 8. Furthermore, as described with reference to FIG. 4, a linear rail 33 which acts as a guide member is fixed at the underside of the supporting bracket 30. A slider 34 which acts as an engaging member is movably disposed at this linear rail (guide member) 33, and said slider 34 is fixed on the upper face of said frame drive member 10 via a moving member 37. That is, since the moving member 37 fixed at the upper face thereof is caused to move in engagement with the linear rail 33, the frame drive member 10 is held in such a state that the vertical displacement thereof is completely regulated.

Furthermore, the frame drive member 10 is driven by a sub drive mechanism 40 already described with respect to FIG. 5. That is, the sub drive mechanism 40 shown in FIG. 9 is basically identical in construction to the sub drive mechanism described in FIG. 5. Accordingly, the parts which are identical to those used in the sub drive mechanism shown in FIG. 5 are indicated with the same reference numbers in FIG. 9. And the detailed description thereof is also omitted. If the linkage axis 13 is rotated by normally or reversely rotating the drive motor 14 shown in FIG. 8 in this sub drive mechanism 40, the drive pulley 45 fixed at said linkage axis 13 is caused to rotate, whereby said moving member 37 is caused to reciprocate in the Y direction via a wire 48. Accordingly, the frame drive member 10 on which the moving member 37 is fixed will be caused to reciprocate in the Y direction. That is, in this preferred embodiment, by the sub drive mechanism 40 driven by the drive motor 14 which causes the frame drive member 10 in the Y direction, the central portion of said drive member 10 is simultaneously caused to move at the same speed as that of both the ends. Therefore, the frame drive member 10 will produce no strain in the lengthwise direction thereof. Accordingly, accurate movements are given to the embroidering frame 26 disposed at the frame drive member 10, and a shortcoming, by which an image slip of the embroidering image is produced among the respective sewing heads 5, can be solved.

Figure 10:
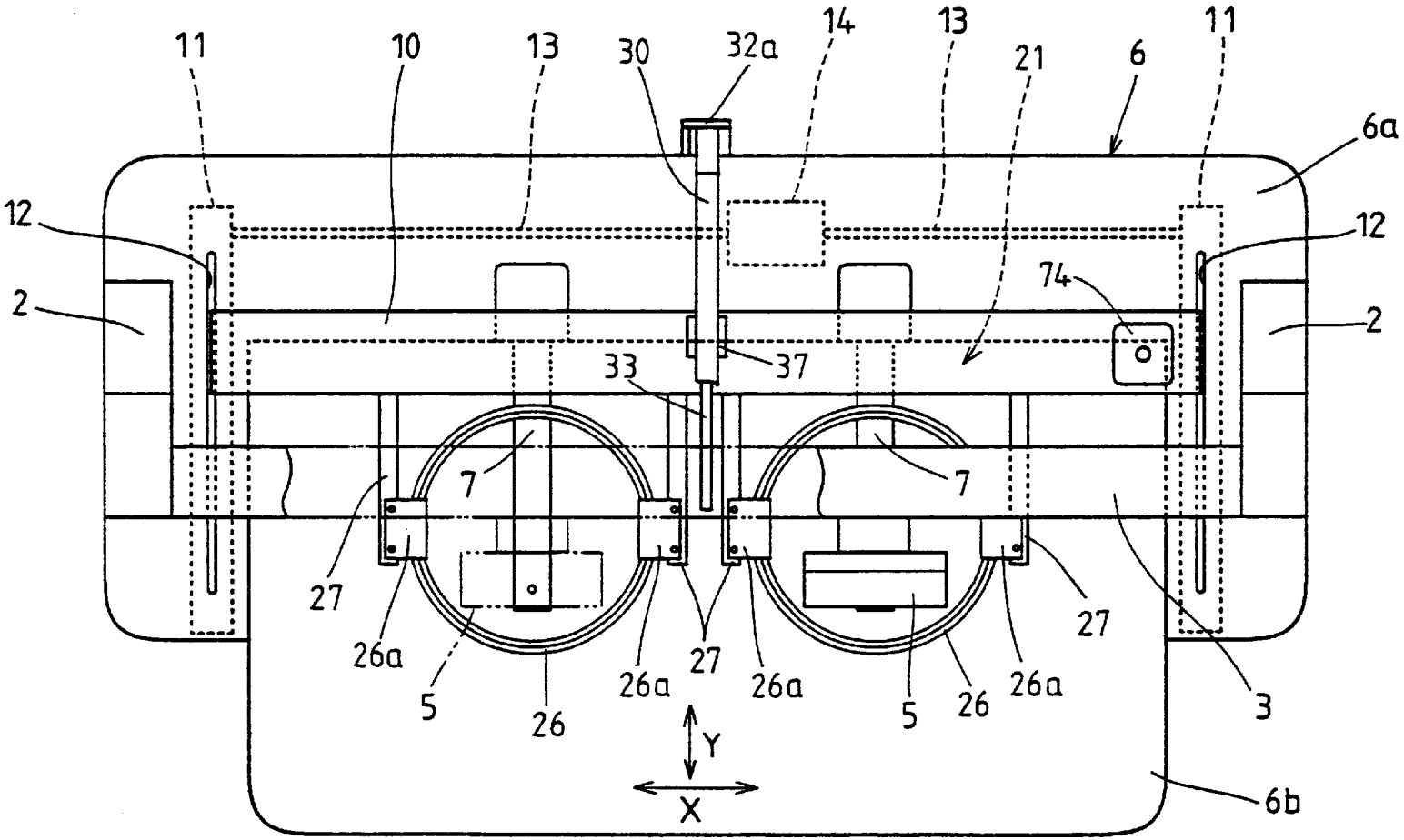
FIG. 10 is a plan view of a sewing machine according to still another preferred embodiment of the invention.
Figure 11:
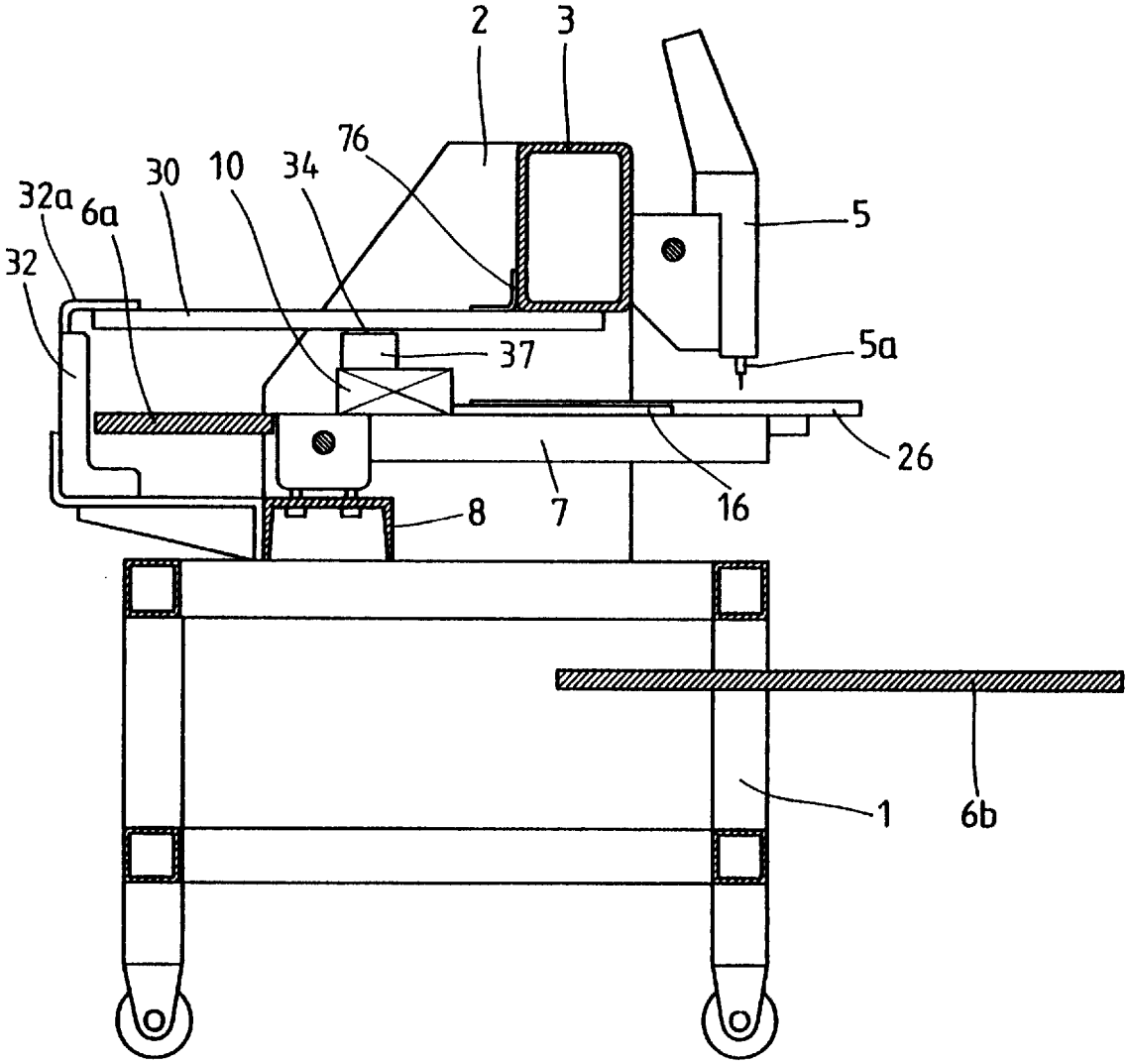
FIG. 11 is a longitudinal side view of a sewing machine illustrated in FIG. 10.

FIG. 10 and FIG. 11 show still another preferred embodiment of the invention, and the basic construction thereof is similar to that described with respect to FIG. 14. Therefore, the parts which are identical to the members described with respect to FIG. 14 are given the same reference number. In the first preferred embodiment described in FIG. 1, although the long frame drive member 10 is driven so as to move in both the X and Y directions, a frame drive member 10 of a sewing machine according to this preferred embodiment is allowed to reciprocate in only the Y direction. Furthermore, although the frame drive member 10 of the preferred embodiments according to FIG. 1 and FIG. 8 is provided with a sub drive mechanism 40, the frame drive member 10 of this preferred embodiment is not provided with any sub drive mechanism. Accordingly, the construction thereof is further simplified.

A sewing machine according to this preferred embodiment is, as described with reference to FIG. 14, provided with Y direction drive portions 11,11 as a mechanism which causes the frame drive member 10 to reciprocate in the Y direction. Furthermore, the same is provided with an X-direction drive mechanism 21 as a mechanism which causes the embroidering frame 26 to reciprocate in the X direction relative to the frame drive member 10. The construction of this X-direction drive portion 21 is identical to that of the drive portion explained with reference to the preferred embodiment, for example, in FIG. 8. The sewing table 6 is, as shown in FIG. 11, divided into a fixed table 6*a* located upward, and an elevation table 6*b* located downward thereof.

A supporting bracket 30 which extends in the Y direction (cross direction) at a roughly middle portion in the X direction (longitudinal direction) of a sewing machine is roughly horizontally disposed upward of said long frame drive member 10. That is, as shown in FIG. 11, the front end of said supporting bracket 30 is fixed on the underside of the upper frame 3 via a bracket 76, and the rear end thereof is fixed at the erect portion 32*a* of the bracket 32 fixed at the rear side of the lower frame 8. As explained with respect to FIG. 5, a linear rail 33 which acts as a guide member is fixed on the underside of said supporting bracket 30. A slider 34 which acts as an engaging member is movably disposed at said linear rail 33, and said slider 34 is connected to the moving member 37 fixed on the upper surface of said frame drive member 10.

Therefore, if the frame drive member 10 is driven by the Y-direction drive portions 11,11 and is caused to reciprocate in the Y direction (longitudinal direction), the slider 34 fixed on the upper face of said frame drive member 10 is caused to move along the linear rail 30. For this reason, the frame drive member 10 is held in such a state that the vertical displacement thereof is completely regulated by the linear rail 33 fixed at said supporting bracket 30. That is, even though the weight of a material textile to be embroidered, which is stretched and held at the embroidering frame 26 illustrated is increased, the frame drive member 10 is free from any inclination, and furthermore such a shortcoming as the holding frame is suspended can be solved. Furthermore, in this preferred embodiment, a linear rail is used as a guide member 33 and a slider is used as an engaging member 34. However, they are not limited to these members. If they are a rectilinear guide member, for example, a guide rail, on the underside of which a sliding way is formed, may be used as a guide member, and a sliding element, at which a sliding way which is engaged with the sliding way of said guide rail, may be used as an engaging member.

Figure 12:
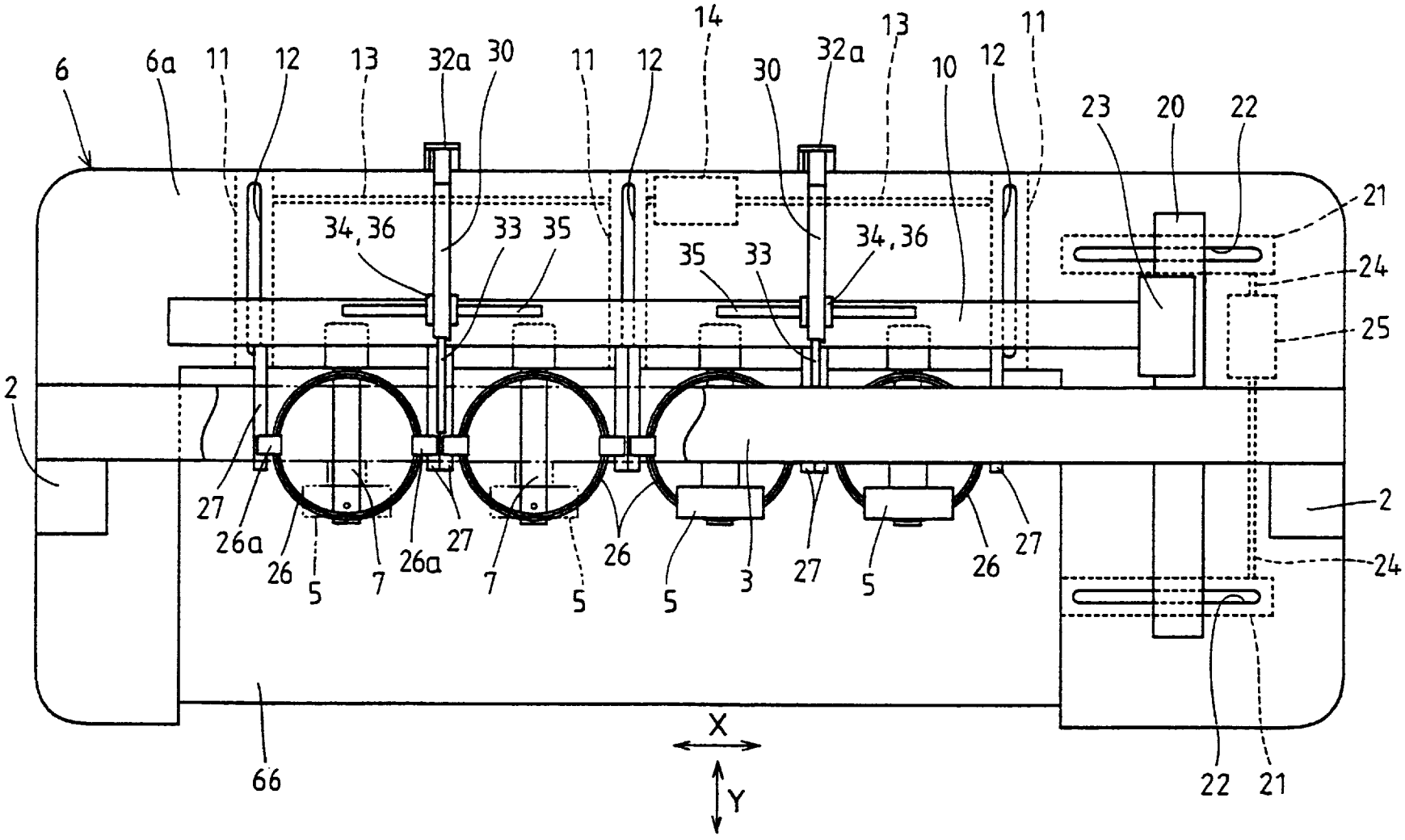
FIG. 12 is a plan view of a sewing machine according to the preferred embodiment of the invention.
Figure 13:
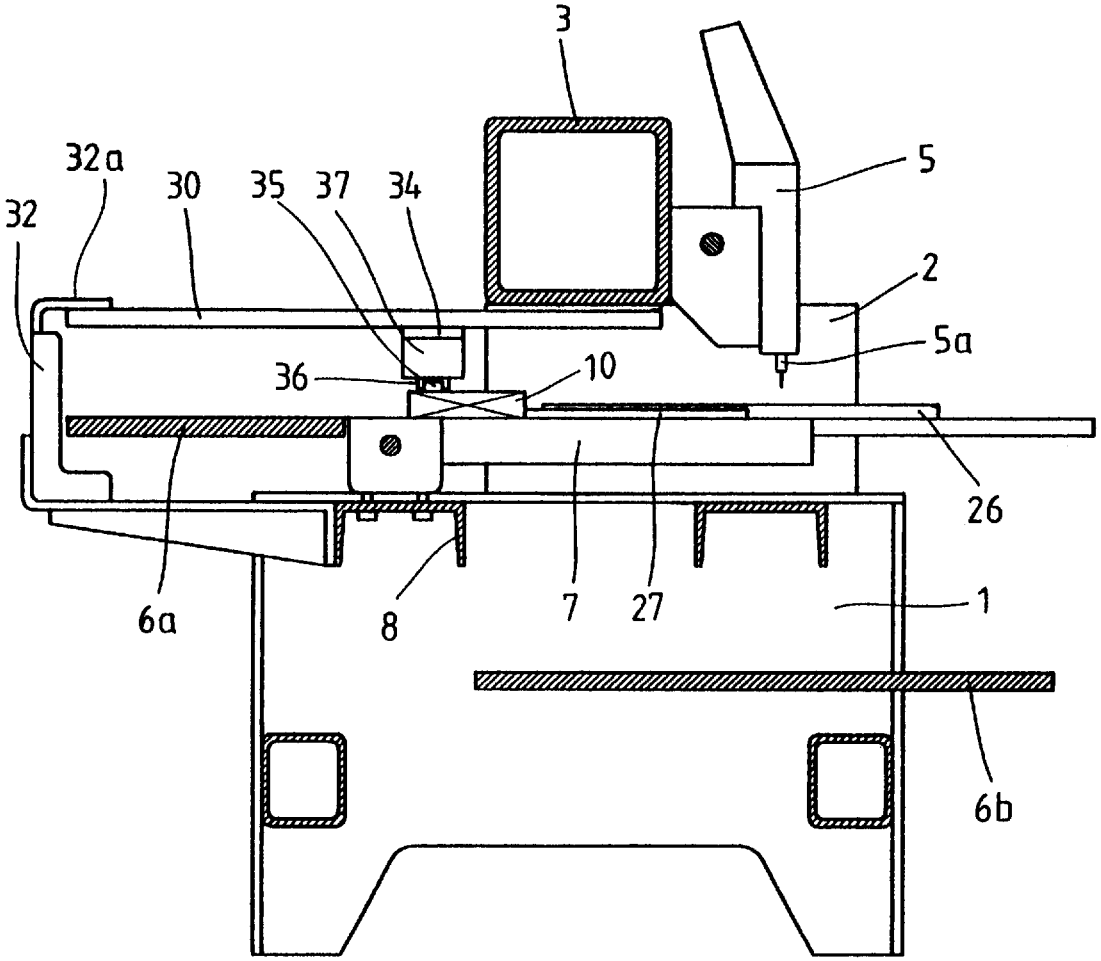
FIG. 13 is a longitudinal side view of a sewing machine illustrated in FIG. 12.

FIG. 12 and FIG. 13 show still another preferred embodiment of the invention. The basic construction thereof is similar to that described with respect to FIG. 1 and FIG. 2. Therefore, the parts which are identical to the members described with respect to FIG. 1 and FIG. 2 are given the same reference numbers as those in these drawings. In this preferred embodiment, as in the first preferred embodiment shown in FIG. 1, a long frame drive member 10 is driven so as to move in both the X and Y directions. However, although the frame drive member 10 according to the first preferred embodiment shown in FIG. 1 is provided with a sub drive mechanism 40, the frame drive member 10 according to this preferred embodiment is not provided with a sub drive mechanism.

In FIG. 12, a long frame drive member 10 is connected to three Y-direction drive portions 11 of the same mechanism described with respect to FIG. 1. That is, the Y-direction drive portion 11 is a general drive mechanism which is able to give a rectilinear reciprocation movement to the frame drive member 10, and a roller (not illustrated) which functions as a drive element thereof is fitted into an X-direction guide groove (not illustrated) formed on the underside of the frame drive member 10 via a Y-direction slit 12 established at the fixed table 6*a*, corresponding thereto. Therefore, said frame driven member 10 is allowed to move in the X direction, and upon receiving a drive force from an X-direction drive member 20 described later, said frame drive member 10 is caused to move in the X direction.

Furthermore, the X-direction drive member 20 is comprised of the same construction described with respect to FIG. 1 and is placed on the fixed table 6*a*. Both the ends in the Y direction (longitudinal direction) at the X-direction drive member 20 are connected to the X-direction drive portion 21 disposed on the underside of the fixed table 6*a*. This X-direction drive portion 21 is provided with a drive mechanism which is similar to the Y-direction drive portion 11, and the drive element thereof (not illustrated) is connected to the underside of said X-direction drive member 20 via an X-direction slit 22 secured at the fixed table 6*a*. This X-direction drive member 20 is linked with the right end portion of the frame drive member 10 via a linkage member 23. Therefore, said frame drive member 10 is able to move in the X direction integrally with the X-direction drive member 20, and at the same time is able to independently move in the Y direction. Two X-direction drive portions 21,21 are connected to each other via the linkage axis 24 illustrated and the X-direction drive motor 25, and by normally or reversely rotating said motor 25, said frame drive member 10 is caused to reciprocate in the X direction via the X-direction drive portion 21, X-direction drive portion 20 and linkage member 23.

A sewing machine according to this preferred embodiment is, as in a sewing machine of the preferred embodiment shown in FIG. 10, provided with a mechanism which is able to hold the posture of the frame drive member 10. For example, as shown in FIG. 12, upward of the frame drive member 10, a supporting bracket 30 consisting of a long material is roughly disposed at a roughly middle position of the Y-direction drive portions 11,11 which are adjacent to each other, and extends in the Y direction (longitudinal direction). That is, said supporting bracket 30 is, as shown in FIG. 13, the front end portion thereof is fixed on the underside of said upper frame 3, and the rear end thereof is fixed at the erect portion 32*a* of the bracket 32 fixed at the rear side the lower frame 8. As already described with respect to FIG. 5, a linear rail 33 which acts as a guide member is fixed on the underside of the supporting bracket 30, and a slider 34 which acts as an engaging member is movably disposed on the linear rail 33.

Furthermore, a linear rail 35 is disposed along the lengthwise direction at appointed positions on the upper face of the frame drive member 10 and extends orthogonally to said linear rail 33. The length along which this linear rail 35 is disposed covers the area where said supporting bracket 30 reciprocates in the X direction, and a slider 36 is movably provided on said linear rail 35. Both the slider 34 secured at said one linear rail 35 and slider 36 secured at said other linear rail 35 are mutually fixed via a moving member 37. Therefore, if the frame drive member 10 is driven by the Y-direction drive portion 11 and moves in the Y direction (longitudinal direction), the slider 34 moves along the linear rail 33 in line therewith. Furthermore, if the frame drive member 10 is driven by the X-direction drive portion 21 and moves in the X direction (cross direction), the slider 36 moves along the linear rail 35 in line therewith. At this time, the vertical displacement of the frame drive member 10 is regulated by the linear rail 33 fixed at the supporting bracket 30. Accordingly, even though the weight of cloth to be embroidered, which is stretched on the embroidering frame 26 is increased, such shortcomings can be solved that the frame drive member 10 is inclined or the holding arms will suspend.

In various preferred embodiments described above, a mechanism mainly consisting of a belt applied to pulleys is shown with respect to a Y-direction drive portion 11 which causes the frame drive member 10 to reciprocate in the Y direction (longitudinal direction) and an X-direction drive portion 21 which causes said frame drive member 10 to reciprocate in the X direction (cross direction). However, the same is not limited to this mechanism. For example, such types are available as where the frame drive member 10 may be driven and controlled by a duplex type actuator, and a screw which is driven and rotated by an electric motor and nut screwed therewith are attached to the frame drive member 10 and may be used for movements and control of the frame drive member 10.

As described above, according to a sewing machine pertaining to the invention, since the intermediate portion of the frame drive member is driven and is caused to move in the Y direction by a sub drive mechanism in synchronization with the Y-direction frame drive portion, said frame drive member is able to be moved with no strain produced in the lengthwise direction unless the rigidity of the said frame drive member is increased so much. Therefore, it is possible to accurately drive and move the holding frame to be attached onto the frame drive member and a material textile to be embroidered, which is stretched and held directly on the frame drive member. Still furthermore, since it is not necessary increase the rigidity of the frame drive member so much, the weight thereof is lightened, whereby even though a sewing operation is carried out at a high speed, it is possible to suppress the vibration and noise at a low level. Furthermore, even in a case where no sub drive mechanism is provided, it is possible to securely prevent the frame driven member from being inclined due to loads of an embroidering frame, etc. to be attached to the holding arms and to prevent said holding arms from being forward suspended, resulting therefrom.

What is claimed is:

1. A sewing machine comprising:

a frame drive member which is a long member extending in an X-direction on a horizontal X-Y coordinates plane;

a Y-direction drive portion which moves said long frame drive member in a Y direction by supporting said frame drive member at roughly both end portions in a lengthwise direction of said frame drive member;

a plurality of holding arms provided on said long frame drive member so as to be caused to move in the X-direction, said holding arms having end portions which extend in the Y direction so that an embroidering frame is held at each of said end portions; and an X-direction drive portion for moving said plurality of holding arms in the X-direction with respect to said frame drive member;

wherein said sewing machine being characterized in comprising:

a guide member fixed above roughly a middle portion of said frame drive member so that said guide member extends horizontally in the Y direction of a movement area of said frame drive member in the Y direction;

an engaging member provided on an upper surface of said frame drive member and at directly below said guide member, said engaging member being movable in the Y direction along said guide member with said engaging member being engaged with said guide member; and wherein when said Y-direction drive portion is activated, said frame drive member is moved in the Y direction together with said engaging member while said frame drive member is suspended at roughly a middle portion thereof by said engaging member.

2. A sewing machine according to claim 1, wherein said engaging member is connected to an endless belt which is applied between a drive pulley and a driven pulley so that a supplemental drive of said engaging member in the Y direction is effected by actuating a motor connected to said drive pulley in synchronization with said Y direction drive portion.

3. A sewing machine according to claim 1, wherein said embroidering frame is held horizontally by a plurality of linkage members which are provided on said frame drive member for causing said embroidering frame to move in the X-direction.

* * * * *